United States Patent [19]

Chandler et al.

[11] 4,130,329

[45] Dec. 19, 1978

[54] ELECTRICAL CONNECTOR ASSEMBLY RETENTION SYSTEM

[75] Inventors: Curtis S. Chandler, Walkertown, N.C.; Ralph L. Miller, Kernersville, Pa.

[73] Assignee: AMP Incorporated, Harrisburg, Pa.

[21] Appl. No.: 840,349

[22] Filed: Oct. 6, 1977

[51] Int. Cl.[2] ..... H01R 13/54; H01R 13/58

[52] U.S. Cl. ..... 339/75 M; 339/91 R; 339/103 M

[58] Field of Search ..... 339/75 M, 91 R, 103 R, 339/103 M, 103 C, 107, 39, 79; 174/138 F

[56] References Cited

U.S. PATENT DOCUMENTS

| | | | |
|---|---|---|---|
| 3,707,696 | 12/1972 | Carter | 339/103 M X |
| 3,751,579 | 8/1973 | Notiri | 339/103 R X |
| 3,904,265 | 9/1975 | Hollyday | 339/103 M |
| 3,936,129 | 2/1976 | Guy | 339/103 R |
| 4,035,051 | 7/1977 | Guy | 339/107 X |

*Primary Examiner*—Roy Lake
*Assistant Examiner*—E. F. Desmond
*Attorney, Agent, or Firm*—Gerald K. Kita

[57] ABSTRACT

The present invention relates to a toolless retention system for a pair of connectors intermated to form a connector assembly.

3 Claims, 9 Drawing Figures

ELECTRICAL CONNECTOR ASSEMBLY RETENTION SYSTEM

BACKGROUND OF THE INVENTION

U.S. Pat. No. 3,760,335, discloses a multi-contact connector housing having a mating side and a conductor receiving side which is provided with rows of electrical contact terminals to which are terminated wires of a multi-conductor cable. The connector includes a removable cover which includes grooves extending axially along the internal sides, the grooves conforming to the rows of contact terminals having the wires terminated thereto. The cover is applied to the connector housing by aligning the grooves with the rows of terminals and sliding the cover grooves axially over the rows of terminals. The cover conforms to the rows of terminals, thereby retaining the conductors in electrical connection with the terminals. The semi-circular cable support is integral with one end of the cover. A cable jacket containing the terminated conductors is impinged against the cable support and is secured thereto by an encircling strap type cable clamp. A semi-circular shim is inserted under the clamp so that the shim and cable support cooperate to encircle and to grip the cable under the clamp. The strap is anchored by a threaded fastener passing through one end of the cover.

The mating side of the connector can be a plug configuration or a receptacle configuration. The mating side of the connector is separated from the conductor receiving side by an integral flange completely encircling the connector. A plug and a receptacle are intermated and locked together with threaded fasteners passing through the flanges. One fastener also passes through a flange on one end of each cover, opposite the end provided with the cable clamp. Securing two intermated housings together requires loose piece fasteners and assembly tools.

SUMMARY OF THE INVENTION

An object of the present invention is to provide a connector of the type described with a latching mechanism for interlocking a pair of intermated connectors yet allowing manual unlocking and separation of the connectors without tools.

This and other objects of the invention are made apparent to one of ordinary skill in the preferred embodiment of the invention comprising a connector plug or receptacle provided with a sheet metal latching spring or clip having two resilient cantilever fingers connected by a bight. The fingers overlie the external sides of the connector plug to project into a central cavity that receives the connector plug or receptacle therein. The enlarged tips detent in recesses of the connector receptacle when the receptacle and plug are intermated. The plug and receptacle are thereby latched together. The spring is unlocked by manually depressing the bight portion which thereby forces the spring fingers to traverse axially along the grooves and the finger tips to move out of the recesses and thereby out of engagement with the connector receptacle.

A cover for either the plug or receptacle includes a projecting button which detents in a notch of the connector external flange, thereby locking the cover on the respective connector flange. The button is integral with a resiliently deflectable tab provided on the cover. The tab is manually deflected to disengage the button from the flange and allow removal of the cover from the connector as desired.

The cover further is provided with an integral cable support having parallel arms. A multi-conductor cable is received between the arms which are provided with multiple ratchet teeth on their inwardly facing sides. The cable clamping plug is manually inserted between the arms of the cable support. The plug is provided with rows of teeth which lock with those of the arms to lock the plug in position at any depth of insertion between the arms whereby clamping pressure on any diameter cable is attainable. The cable support includes an integral rib which is compressed axially on the cable to prevent shifting of the cable while clamped.

DETAILED DESCRIPTION

Figure 1:
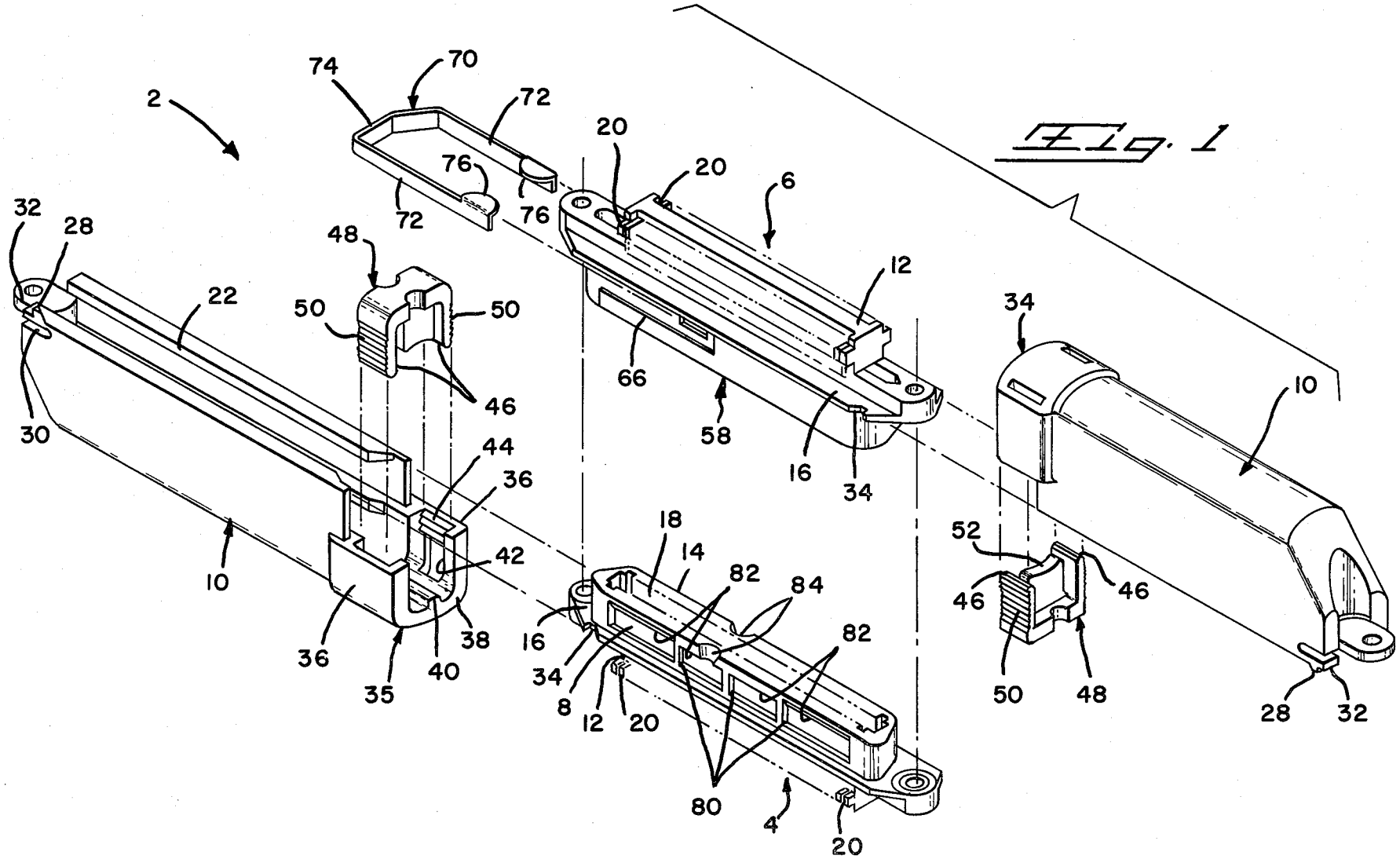
FIG. 1 is a fragmentary perspective of a preferred embodiment of a connector assembly according to the present invention with component parts in exploded configuration to illustrate the details thereof.
Figure 2:
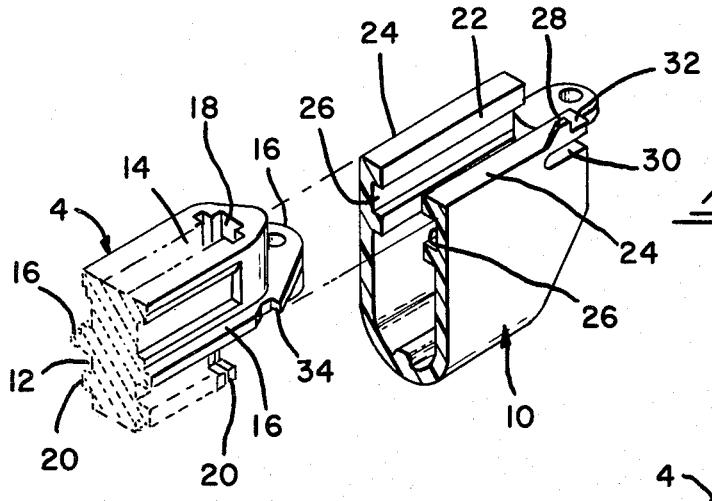
FIG. 2 is an enlarged fragmentary perspective of a section of the receptacle portion of the connector assembly shown in FIG. 1 illustrating a housing portion and a cover portion in exploded configuration to illustrate the details thereof.
Figure 3:
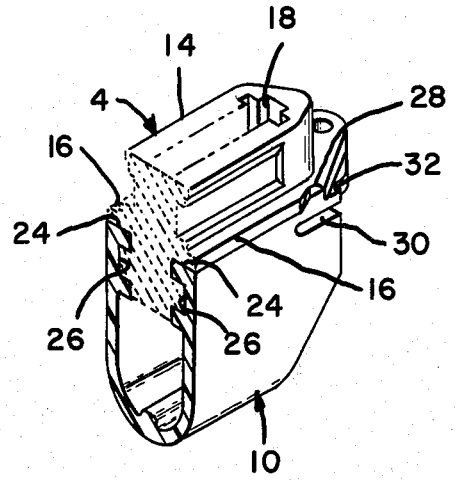
FIG. 3 is an enlarged fragmentary perspective of an assembly of the component parts illustrated in FIG. 2.
Figure 4:
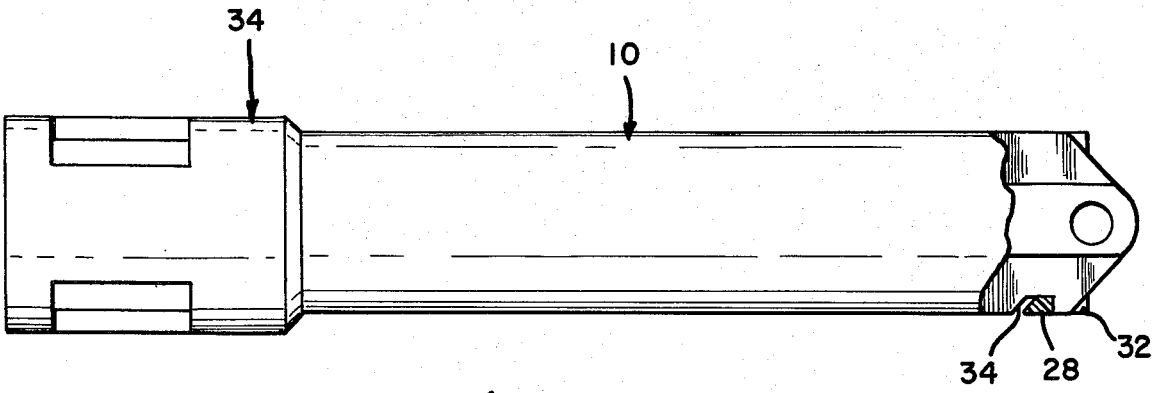
FIG. 4 is a top plan view of a cover portion of the connector assembly shown in FIG. 1 assembled onto the plug portion.

With reference to FIGS. 1–3, an electrical connector assembly 2 according to the invention comprises a connector receptacle part 4 and a connector plug part 6. The plug and receptacle parts are in some respects identical to those described in detail in U.S. Pat. No. 3,760,335, and in some respects modified to accommodate the features of the present invention which will be described in greater detail.

The receptacle part of the connector assembly comprises a housing 8 of suitable dielectric material and a cover or shroud 10 which is removably secured to the rearward conductor receiving side 12 of the housing. The connector has a mating side or face 14 and a flange 16 which extends circumferentially outward adjacent to the rearward or conductor receiving side of the housing, thereby separating the conductor receiving side from the mating side thereof. The mating face of the mating side 14 includes a central cavity 18 containing electrical contact terminals, not shown but described in U.S. Pat. No. 3,760,335. The terminals are arranged in spaced elongated rows, with tail portions of the terminals emerging at the conductor receiving side 12 for connection to individual conductors of a multi-conductor cable in accordance with the detailed description of U.S. Pat. No. 3,760,335. At the conductor receiving side 12 the individual terminals are separated by barriers 20 portions of which project outwardly. The projecting portions of the barriers are arranged in two lengthwise rows, one on each side of the conductor receiving side 12. Each of the rows is in spaced relationship from the flange 16 and is used for alignment of the cover during assembly of the same to the receptacle 4.

More particularly, the cover 10 includes an open side 22 flanked by longitudinal or axial marginal edges 24 which are relatively thickened in section, as shown in FIGS. 2 and 3. The thickened section of each marginal edge 24 includes an axial inwardly directed groove 26. When the cover 10 is assembled to the receptacle 4 as shown in FIGS. 2 and 3 the cover grooves 26 are aligned with the rows of barrier projecting portions 20. The cover then is assembled to the receptacle by axially sliding the cover along the barrier projecting portions 20 progressively inserting the rows of barrier projecting portions 20 into the grooves 26.

One of the thickened margins 24 of the cover is provided with an integral projecting button 28 generally of wedge shaped configuration. The cover includes a relatively narrow axially extending slot 30 defining a relatively thin and stiffly resilient tab 32 adjacent an end of the cover which tab carries the projecting button 28 integrally thereon. The flange 16 is provided with a relatively small notch portion 34 providing a detent for locking registration of the button 28 therein when the cover is fully assembled to the receptacle for as shown in FIG. 3. It is to be understood that no tools are required for the assembly of the cover as shown in FIG. 3. The tab 32 is subjected to resilient deflection upon manual assembly of the cover to the receptacle 4 to allow the button 28 to pass under a portion of the flange 16 until in registration with the notch 34. If it is desired to unlock the cover and disassemble the same from the receptacle 4, a portion of the tab 32 which projects outwardly from the flange 16 as shown in FIG. 3, is manually depressed to disengage the button 28 from the receptacle 34 and allow removal of the cover from the receptacle 4. In practice, since the tab 32 is relatively stiff, it is necessary first that manual pressure be applied in such a nature as to urge relative sliding of the cover with respect to the receptacle. Then upon applying a manual downward thrust to the tab 32 the cover will immediately begin to move slidably. Such a manual operation will cause the cover to slide with respect to the receptacle upon the slightest momentary disengagement of the button 28 from the notch 34.

Figure 9:
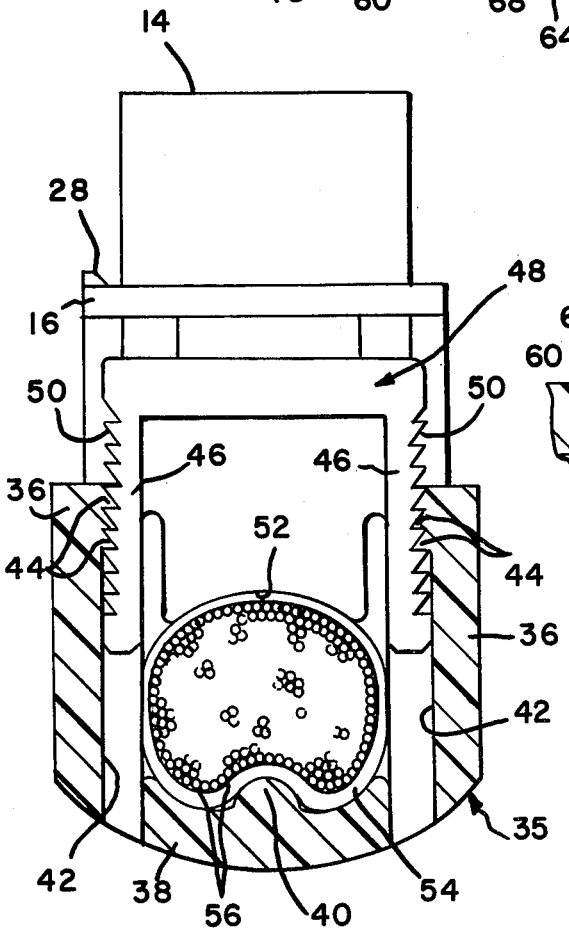
FIG. 9 is an enlarged end elevation of the receptacle according to the present invention terminated with a multi-conductor cable, with the view in section illustrating the details of cable clamping and retention with the receptacle.

As shown more particularly in FIGS. 1 and 9, the cover 10 opposite the end provided with the button 28 is provided with an integral cable support 35 generally of U-shaped configuration. The cable support is characterized by a pair of spaced parallel arm portions 36 integrally connected by a bight portion 38. A projecting integral rib 40 is provided on the bight portion extending axially of the connector and having its sharp corners rounded. On the inwardly facing sides of the arms 36, are provided corresponding laterally recessed channels 42 having projecting ratchet teeth 44 therein. The teeth 44 comprise a plurality of undercut shoulders which are interconnected by wedge shaped surfaces. The channels 42 are of a width complementary with receipt of the width of a pair of depending arms 46 provided on an inverted U-shaped plug or pressure pad 48. The externally facing sides of the arms 46 are provided with a relatively lengthy series of ratchet teeth 50 adapted for locked engagement with the teeth 44. In particular the teeth 50 are defined by shoulder portions interconnected by undercut wedge shaped surfaces. When the plug 48 is assembled to the cable support 34 the undercut wedge shaped surfaces of the teeth 50 are wedgingly forced past the wedge shaped surfaces of the teeth 44, allowing any desired depth of insertion of the plug 48 in the cable support 35. Removal of the plug 48 is prevented by interlocked engagement of the shoulder portions of the teeth 50 with the inverted shoulder portions of the teeth 44. The plug 48 includes an integral pressure pad 52, the inverted surface of which is arcuate to engage the circumferential surface of a cable jacket 54 containing a plurality of conductors, some of which are shown at 56 adapted for connection to the contact terminals contained in the receptacle 4. In practice, once the cable and its jacket 54 and conductors 56 thereof are received between the arms 36 of the cable support, plug 48 may be assembled to the cable support without the need for tooling. The depth of insertion of the plug 48 between the arms 36 determines the amount of clamping and gripping pressure to be applied to the cable by the arcuate surface 52 and the bight portion 38. It has been found that the gripping pressure can be substantially increased if the cable is required to deform in a pliant manner for conformation with the surface of the projecting rib 40. The rib 40 thereby provides a longitudinal indentation in the compliant cable preventing shifting of the cable with respect to the connector support 34 and thereby enhancing cable strain relief resisting movement of the cable with respect to the connector portion to which it is terminated. The need for a tensioning strap or tooling to provide the cable strain relief is obviated.

The plug portion of the connector 6 also is provided with a conductor receiving side 12 having the projecting portions 20 for mounting a cover 10 thereover. When a multi-conductor cable has the individual conductors thereof terminated in the conductor receiving side 12 a shroud or cover 10 is applied thereover and a strain relief is provided by insertion of a plug 48 into the arms of the cable support 35.

Figure 5:
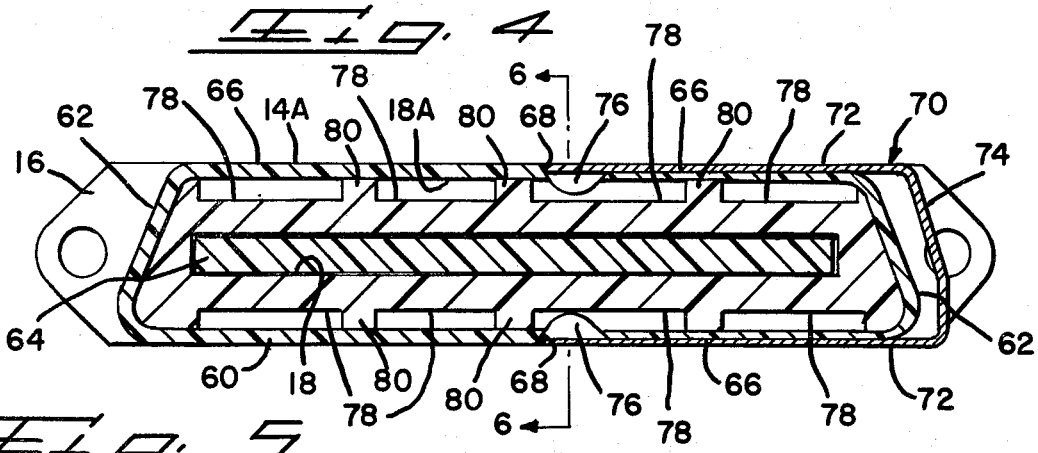
FIG. 5 is a longitudinal section of a complete assembly of all the component parts illustrated in FIG. 1 illustrating the locking together of the plug and receptacle.
Figure 7:
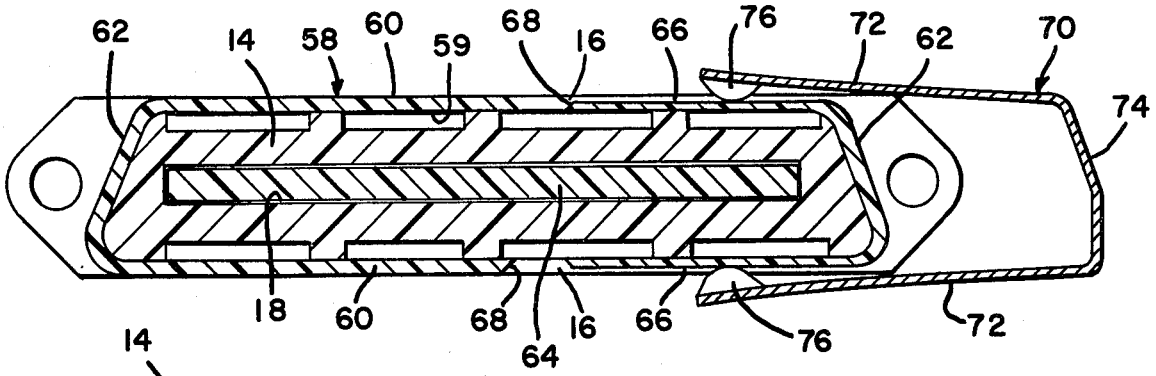
FIG. 7 is a view similar to FIG. 5 illustrating a latching spring or clip partially assembled on the connector assembly.

In some respects the plug portion 6 is different from the receptacle portion 4 by the mating side of the plug portion illustrated generally at 58 in FIGS. 1, 5, and 7. The mating side 58 includes a central cavity 59 defined by spaced axially extending sidewalls 60 joined together at corresponding ends by bight shaped end walls 62.

Centrally of the cavity 59, the mating face 58 includes an integral projecting plug rib 64 generally centrally of the cavity 59 and of a size for pluggable receipt into the axial cavity 18 of the receptacle mating face 14. Although not specifically shown, it is to be understood that the individual terminal contacts of the plug 60 are distributed along both sides of the rib 64 and make pressure contact engagement with the terminal contacts of the receptacle 4 which are distributed on opposite sides of the cavity 18. Thus when the plug and receptacle are intermated, the one multi-conductor cable and the individual conductors thereof are connected to the individual conductors of another multi-conductor cable through the engaged terminal contacts provided on the plug and receptacle. A more specific and detailed description of the connections appears in U.S. Pat. No. 3,760,335.

As shown more particularly in FIGS. 5 and 7, the sidewalls 60 are relatively thin and are provided with relatively narrow grooves 66 extending axially from a common end of the mating face 58 and extending axially adjacent the flange 16. Each of the sidewalls 60 is provided with a recess 68 therethrough communicating with the internal cavity 58 and with a corresponding groove 66.

A generally U-shaped metal spring clip is illustrated generally at 70 and includes a pair of cantilever resilient spring fingers 72 connected by a bight portion 74. The clip 70 is stamped and formed from sheet metal and the free ends of the fingers 72 include enlarged convex arcuate portions 76 which are originally formed in the respective planes of the fingers 72 and then bent to project both perpendicularly from the planes of the fingers 72 and toward each other.

FIG. 7 illustrates assembly of the clip 70 onto the mating face 58. More particularly, the tips 76 are slidably traversed along the corresponding grooves 66, with the spring fingers 72 being resiliently biased outwardly away from each other. As shown in FIG. 5, the tips 76 then register within corresponding recesses 68 allowing the fingers 72 to register within and along the grooves 66. The fingers 72 are initially biased resiliently toward each other such that when the tips 76 register within the recesses 68 the fingers 72 will firmly register within the grooves 66.

Figure 6:
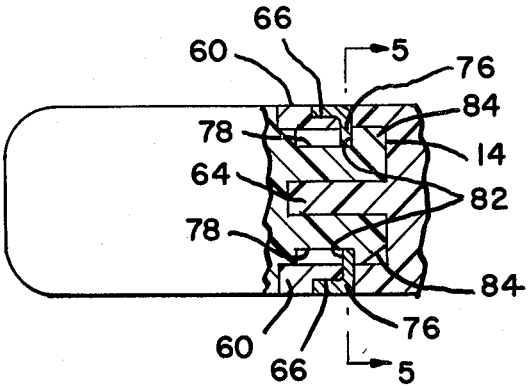
FIG. 6 is a section taken along line 6—6 of FIG. 5.

As shown more particularly in FIGS. 1 and 6, the mating face 14 of the receptacle 4 is provided with a series of rectangular indentations 78 defining projecting reinforcing ribs 80 intersecting projecting undercut shoulders 82 immediately adjacent and parallel with the mating face of the mating side 14. When the plug and receptacle are intermated, the tips 76 project into the central cavity 59 of the plug and register within corresponding indentations 78 on opposite sides of the receptacle. The tips 76 further lockingly engage against the undercut shoulders 82 of such corresponding indentations 78 lockingly retaining the plug and receptacle intermated.

As shown more particularly in FIGS. 1 and 6, the mating face of the receptacle is provided with arcuate chamfers 84 in alignment with the tips 76 when the plug and receptacle are intermated. When the mating face of the receptacle is received within the cavity 59 of the plug, the tips 76 engage the chamfers 84 and are cammed outwardly by the chamfers 84, allowing passage of the receptacle mating side into the plug cavity past the finger tips 76. Once the plug and receptacle are fully intermated the tips 76 will snap resiliently into registration within the corresponding recesses 78 due to the resilient action of the spring fingers 72. When the plug and receptacle are intermated the flanges will be spaced apart and the spring clip will be in the space between the flanges and be protected thereby.

Figure 8:
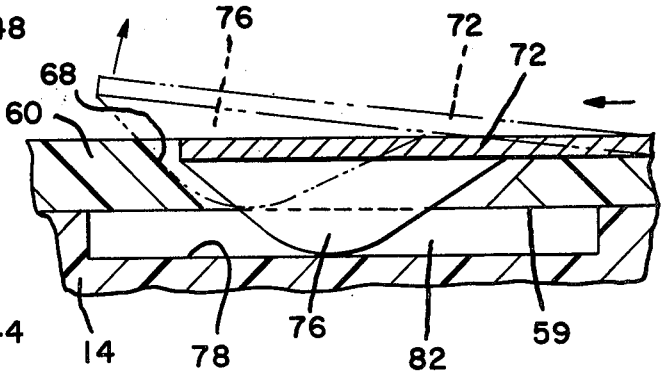
FIG. 8 is an enlarged fragmentary view of a portion of FIG. 5 illustrating the unlocking of the latching spring or clip from the connector assembly.

With reference to FIGS. 5 and 8 release of the spring clip will be described in detail. FIG. 8 illustrates that the recesses 68 in the sidewalls 60 have tapered side surfaces facing the convex arcuate finger tips 76. FIG. 5 illustrates that the bight portion 74 of the clip 70 is in spaced relationship from one end wall 62 overlied by the bight portion 74. To release the clip, manual pressure is applied against the bight portion 72 forcing the same toward the underlying end wall 62. This forces the fingers 72 to slottably traverse in and along the grooves 66. This further causes the finger tips 76 to slidably ride up or traverse along the inclined surfaces 68 of the recesses 68, whereby the tips 76 are biased or cammed by the surface outwardly of the central cavity 59 and thereby disengaged outwardly of the recesses 76 and from locked engagement under the undercut shoulders 82. The plug and receptacle are thereby disengaged and separated without a need for tooling. When the clip 74 is manually released the resilient action of the fingers 72 will resiliently bias the fingers toward each other once again return the finger tips 76 within the recesses 68, such that the fingers 72 will be retained firmly in the grooves 66 in the at rest positions shown in FIG. 5.

What has been shown and described is a preferred embodiment according to the present invention. However, other modifications and embodiments thereof will become apparent to one having ordinary skill in the art as defined by the spirit and scope of the appended claims.

What is claimed is:

1. In a connector having intermatable dielectric housings containing multiple electrical contacts terminated to insulated electrical conductors, together with means latchably retaining said housings intermated, the improvement comprising:

a resilient spring having two elongate resilient fingers connected by an integral bight, the fingers having thickened tips at the free ends thereof initially biased resiliently toward each other, said tips having convex edges bent outwardly of the planes of said fingers to project toward each other perpendicular to the planes of the fingers, one said connector housing having a central cavity defined by elongate parallel sidewalls connected by integral end walls, said sidewalls having apertures therein communicating with said central cavity, said fingers being impinged along said sidewalls with said tips received in said apertures and protruding into said cavity, the other of said housings having a portion which is pluggable within the first housing central cavity, said other housing having a mating face provided with a central cavity containing multiple electrical contacts matable with contacts contained in said first housing, said other housing having elongate sidewalls connected by end walls perpendicular of said mating face, said sidewalls of said other housing having recesses therein defining a series of reinforcing ribs and also undercut shoulders proximate said mating face and intersecting said ribs, said mating face having chamfered surfaced recesses in corresponding sidewalls intersecting corresponding shoulders, said recesses being aligned with said contact edges of said tips when said housings are intermated, whereby said chamfered surfaces resiliently bias said tips outwardly of said central cavity upon receipt of said mating face within said central cavity, and said tips being in registration within corresponding recesses with said convex edges in locked registration under said undercut shoulders thereby maintaining said housings in intermated condition.

2. The structure as recited in claim 1, and further including:

a first flange continuously encircling said first housing perpendicular to said sidewalls and said end walls, a second flange continuously encircling said second housing perpendicular to said sidewalls and end walls thereof, said spring being disposed in a space defined between said first and second flanges when said housings are intermated, and said bight being manually urged into engagement with an end wall of said first housing to bias said tips outwardly of said apertures, disengaging said tips from said undercut shoulders to permit manual separation of said housings.

3. The structure as recited in claim 2, wherein, said first housing includes grooves in the sidewalls thereof receiving said fingers therein, said apertures being aligned with said grooves, and inclined surfaces communicating with said apertures and in alignment with said grooves for receiving said tips when biased outwardly of said apertures.

* * * * *